United States Patent [19]

Zimmern

[11] Patent Number: 4,470,781

[45] Date of Patent: Sep. 11, 1984

[54] POSITIVE DISPLACEMENT MESHING SCREW MACHINE

[76] Inventor: Bernard Zimmern, 27 rue Delabordère,, 92200 Neuilly sur Seine, France

[21] Appl. No.: 427,643

[22] Filed: Sep. 29, 1982

[51] Int. Cl.[3] ..... F04C 2/00

[52] U.S. Cl. ..... 418/195

[58] Field of Search ..... 418/195, 196

[56] References Cited

U.S. PATENT DOCUMENTS

| | | | |
|---|---|---|---|
| Re. 30,400 | 9/1980 | Zimmern | 418/195 |
| 313,695 | 5/1864 | Zimmern | 418/195 |
| 1,654,048 | 12/1927 | Myers . | |
| 3,180,565 | 4/1965 | Zimmern | 418/195 |

FOREIGN PATENT DOCUMENTS

| | | |
|---|---|---|
| 518183 | 12/1920 | France . |
| 974313 | 9/1950 | France . |
| 896859 | 6/1963 | France . |
| 1331998 | 6/1963 | France . |
| 2429909 | 1/1980 | France . |

*Primary Examiner*—John J. Vrablik
*Assistant Examiner*—John J. McGlew, Jr.
*Attorney, Agent, or Firm*—Ziems, Walter & Shannon

[57] ABSTRACT

A positive displacement machine such as a hydraulic pump or motor comprises a screw with several threads rotatable inside a casing and meshing with at least one pinion, and at least one low pressure port and at least one high pressure port located in the casing on either side of the pinion. The portion of the casing comprised between a low pressure port and a high pressure port is in leaktight contact with the whole length of the top of at least one thread of the screw. When said portion is in contact with the tops of two threads, no pinion tooth is in mesh between them. The threads terminate on each side of the screw on substantially equal diameters and have in their central section a swollen portion with an external diameter larger than at the ends of the threads.

12 Claims, 9 Drawing Figures

POSITIVE DISPLACEMENT MESHING SCREW MACHINE

This invention relates to a positive displacement screw machine.

It has been known for some time how to pump liquids, in particular viscous liquids, using a so-called Archimedes screw. Substituting such a screw with a worm cooperating with a pinion, hydraulic pumps and motors have been designed which, better than an Archimedes screw, have been used to deliver liquids at a high pressure.

French patents Nos. 518.183 and 1,354,700 describe devices of this nature which have been built with success.

In such devices the liquid penetrates axially and leaves axially across virtually the entire perimeter of the screw. The advantage is that the liquid penetrates slowly inside the screw, since the axial speed is less than the circumferential speed. This means that this type of pump is little affected by cavitation. Nevertheless the flow rate per turn is limited, since only about one-half the screw fills with liquid at each turn. Moreover it is not easy to avoid compressing or expanding the liquid in the chambers between the time the inlet port closes and the time the exhaust port opens, since the section of the threads naturally varies; and due to the incompressibility of liquids, this may engender appreciable shocks which may entail rupture of parts such as the pinion.

To resolve the problem it has already been proposed in the addition No. 2,029,156 to French Pat. No. 1,586,832 that the axial flow of the liquid be replaced by a circumferential flow, such that the threads of the screw act as the blades of an impeller. Such flow permits separating the suction and delivery ports by a zone in which the thread does not communicate with either of the ports and does not change in volume; it is thus in effect a rotating transfer zone without variation in volume. U.S. Pat. No. 3,708,249 describes a similar flow applied to a cylindrical screw cooperating with a flat pinion while the addendum to French Pat. No. 2,029,156 aforementioned applies to a cylindrical screw cooperating with a cylindrical pinion.

The advantage of the solution in U.S. Pat. No. 3,708,249 is that the contour of the threads terminates on the external diameter of the screw and that on this account the screw is not subjected to any axial thrust. As against this, the drawback is, as will be made clear in the following, that the volume swept by such a screw is relatively small for a given screw dimension. Thus this type of pump is not suited for delivering medium discharge pressures, of a few tens of bars, with an acceptable efficiency: due to the small capacity delivered, the leakage paths are relatively considerable and one has to settle for low volumetric efficiency, unless, in order to improve the latter, the rotation speed is increased, resulting in substantial viscous drag. In either case, the overall efficiency peaks at an unacceptable value.

The object of this invention is to remedy such drawbacks by almost trebling the swept volume without appreciably increasing the leakage paths, while retaining the advantage of a screw fully balanced with respect to axial thrusts, an essential advantage when pressures become high because these thrust forces become prohibitive.

It entails a positive displacement machine such as a hydraulic pump or motor comprising in combination a screw with several threads, rotating inside a fixed casing and meshing with at least one pinion having teeth running inside such casing, at least one low pressure port and at least one high pressure port located in the casing on either side of the pinion, the portion of the casing between the low pressure port and the high pressure port being substantially in continuous leaktight contact with the top of at least one thread of the screw through the entire length of said thread, said portion of the casing being in addition so arranged that when it is in leaktight contact with the tops of any two successive threads, no pinion tooth is in mesh between these two threads and such that the threads terminate on each side of the screw on substantially equal diameters and have in their central section a swollen portion with an external diameter larger than at the ends of the threads.

The outstanding advantage of this embodiment is that whatever the angular position of the screw, axial thrust is constant and proportional to the differential between high and low pressure, which can be compensated by a counteracting piston actuated by the pressure of the discharged liquid and to so obtain a radial thrust as reduced as desired.

By using a screw with two symmetrical pinions, one can even generate a mere torque acting on the screw without axial nor radial thrust, so as to implement a high pressure pump or motor without any problem with the bearings. According to a particularly advantageous embodiment a cylindrical screw ending in two symmetrical cones is used, the length of the cylindrical portion of the screw being such that two teeth of the pinions may completely mesh therein at the same time. It is then found that such an arrangement give rise to an extremely low cyclical fluctuation in the flow, thereby making possible a pump with a virtually pulseless flow with all the advantages this entails such as absence of noise, etc. . . .

Other features and advantages of the invention will be clear from the following description.

In regard to the accompanying drawings, given by way of non limitative examples:

Figure 1:
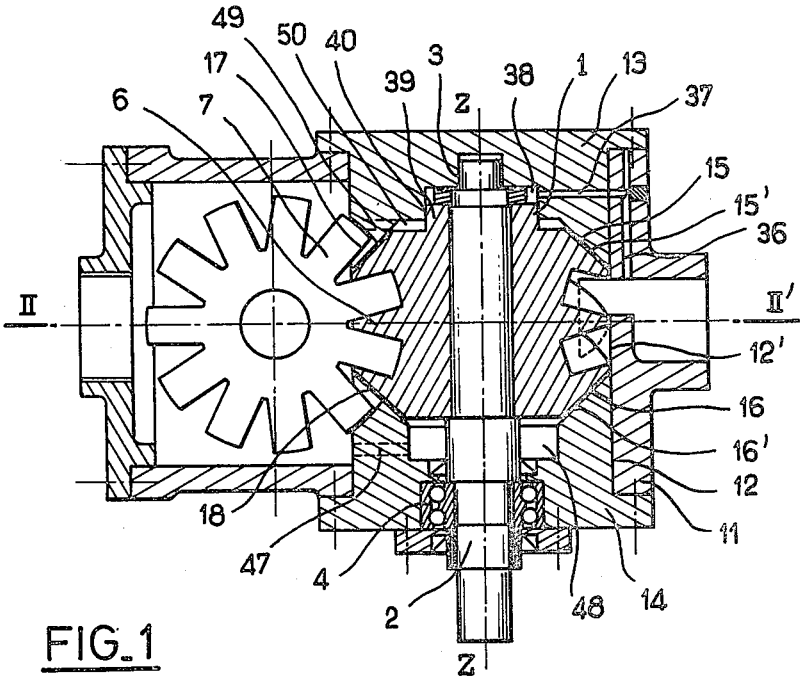
FIG. 1 is a sectional view of a pump according to the invention, along I—I' of FIG. 2.
Figure 2:
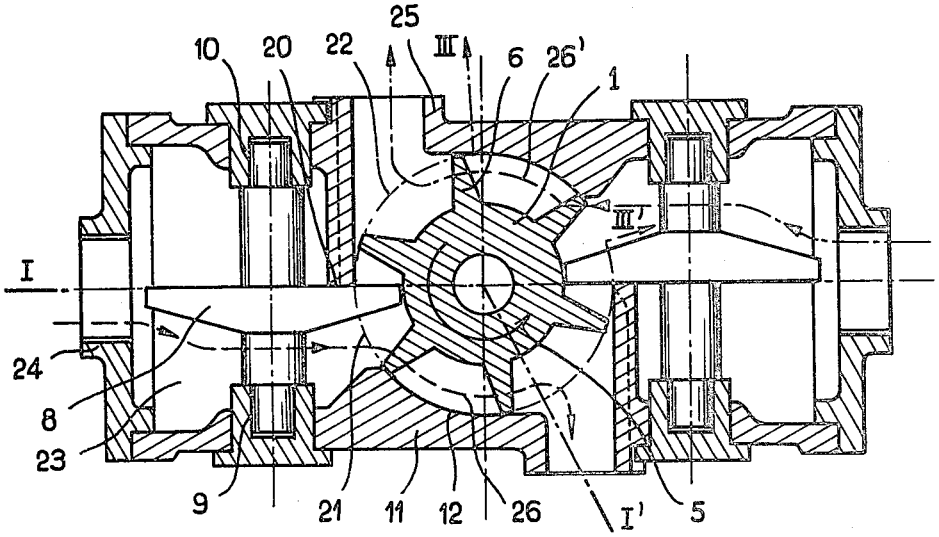
FIG. 2 is a sectional view along II—II' of FIG. 1.

FIGS. 1 and 2 show a screw mounted on a shaft 2 rotating in fixed bearings 3 and 4 in the direction of arrow 5. The screw has several threads such as thread 6 which meshes with the teeth 7 of two symmetrical pinions such as 8, rotating in bearings 9 and 10.

Bearing 4 itself is made up of a pair of annular contact bearings arranged in between two lip seals.

Screw 1 rotates inside a casing consisting of a stationary part 11 provided with a cylindrical bore 12, and of two parts 13 and 14 which are set inside bore 12, and have the conical section 15 and 16 respectively.

Screw 1 is delimited externally by a cylinder 12' terminated by two cones 15' and 16', which, when the screw is inside the casing, are in substantially leaktight contact, i.e. with a very small clearance, with cylinder 12 and the respective cones 15 and 16 of the casing.

Each of the parts 13 and 14 has passages 17 and 18, for the pinion teeth, such passages being, as well as the lip 20 of the casing, in tight contact with the pinion on its side exposed to high pressure.

In addition, bore 12 has two ports on either side of each pinion, one a low pressure port such as 21, the other a high pressure port such as 22. The low pressure port 21 communicates via cavity 23 surrounding the pinion with an inlet conduit 24 for the liquid. The high pressure port 22 ends in a conduit 25 connected to the high pressure liquid discharge piping, not shown here.

When the screw rotates in the direction of arrow 5, the threads 6 cause the liquid to flow along arrows 26 and 26' from the low pressure port to the high pressure port, in the manner of a paddle wheel, but a paddle wheel which would push the liquid positively, and not only dynamically, against the pinion teeth.

Figure 3:
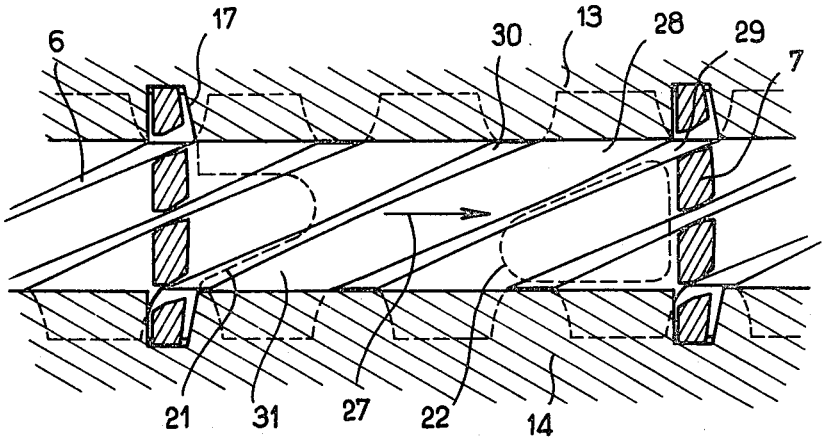
FIG. 3 is a stretched view of the screw along III—III' of FIG. 2.

This operation is perfectly visible on FIG. 3 illustrating a stretched view of the screw, the pinions and the ports along III—III' of FIG. 2. The direction of flow, in the pump mode, corresponding to the rotation indicated by arrow 5, FIG. 2, is shown by arrow 27. In the angular position of the screw thus shown, the groove 28 comprised between threads 29 and 30 is isolated from both the low pressure port 21 through which the liquid comes and from the high pressure port 22, but moreover in this position, none of the pinion teeth mesh with said groove.

If, notionally, the screw is rotated in the direction of arrow 27, it will be also noted that there always is a thread such as 30 in leaktight contact with the part of the housing 31 comprised between ports 21 and 22, namely the low pressure and high pressure ports relating to two different pinions.

There results that on one hand the high pressure is always separated from the low pressure by at least one thread, on another hand, the volume contained between two threads passes from low pressure to high pressure without change in volume since it is not swept by any pinion tooth and hence that there is just a mere transfer.

The result is that the exact position of ports 21 and 22 need not necessarily be very accurate and that in addition the groove between threads 29 and 30 may begin to register with port 22 before it begins to be swept by a pinion tooth, thus preventing any possibility of overpressure.

Similar arrangements using the circumferential flow of a liquid with respect to axial flow are already known by the addition No. 2,029,156 to our French Pat. No. 1,586,832 and by U.S. Pat. No. 3,708,249.

The object of addition No. 2,029,156 however has the major disadvantage that the screw is subjected to axial thrust which may become entirely untenable at high pressures. U.S. Pat. No. 3,708,249 sets out to remedy this drawback in that the screw by being completely cylindrical externally is not subjected to any axial thrust. This solution however is not advantageous since the depth of the grooves of the thread is very limited and there results long leakage paths for a small volume, which is not in favour of good efficiency at high pressure.

According to this invention, the profile is not cylindrical but cylindrical with two cones, of which it will be seen from FIG. 1 that they are substantially symmetrical with respect to the plane, not shown, perpendicular to the axis of the screw and passing through the center of the pinions. There results an axial thrust, but a remarkable result is that the thrust is constant in force and direction, whatever the angular position of the screw. On FIG. 4 is a simplified stretched view of FIG. 3 just before groove 28 communicates with high pressure port 22, and on FIG. 5; just after.

Figure 4:
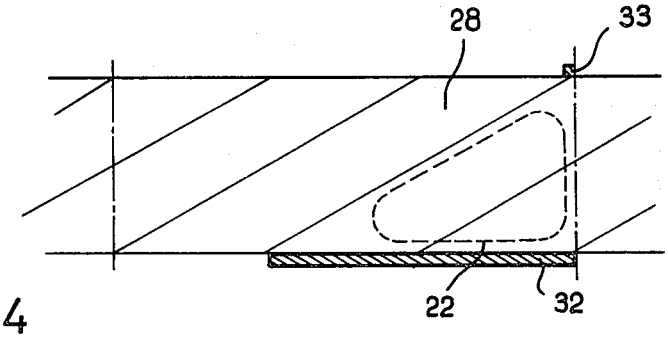
FIG. 4 is a simplified diagrammatic view of FIG. 3 showing the zones of axial thrust prior to the thread registering with the high pressure port.
Figure 5:
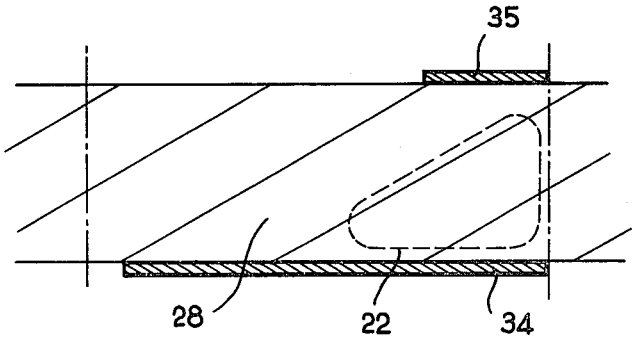
FIG. 5 is a diagrammatic view similar to that of FIG. 4 after registering of such thread with the high pressure port.

The hatched areas 32 and 33 show the areas of the end cones of the screw which undergo the high pressure on FIG. 4, and 34 and 35 are the same areas in the case of FIG. 5. It will be seen that from FIG. 4 to FIG. 5, area 32 has grown into 34 by substantially the width of one groove but that the same also holds for area 33. As both cones have the same maximum and minimum diameters, the increase in thrust is the same for both and as these thrusts are in opposite directions, the resulting force remains constant. Following the same reasoning, it would be found that the thrust remains unchanged throughout all angular positions. It is then easy to cancel this constant thrust by another constant thrust exerted on the screw by means of the high pressure. As shown on FIG. 1, duct means 36 and 37 cause the discharge pressure taken in the discharge conduit to come into cavity 38 in which the liquid under pressure bears on a part 39 of the screw which is piston-shaped and placed in leaktight contact within a bore 40 of part 13. Also, the holes 47 and 49 cause chamber 48 and 50 respectively to communicate with the volume surrounding the pinion; this ensures that the axial thrust on the piston 39 is restricted to the area of this piston and is proportional, if one neglects any axial thrust there may be on shaft 2 in the event that the suction pressure and the pressure outside the pump are different, to the product of such area by the difference between high and low pressure. Choosing a suitable diameter for plunger 39, the axial resultant of the thrust borne by bearing 4 may be rendered as low as desired.

A point worth noting is that it is essential that the two end cones have substantially equal areas, otherwise the screw could be balanced axially on an average, but the thrust would fluctuate in the course of the rotation in the interval between two threads, so that on bearing 4 the thrust would oscillate with the frequency of the number of threads.

If the fluctuation of the thrust is low, meaning if the two cones have substantially equal areas, the fluctuating thrust may be acceptable. But if the areas differ greatly and if the fluctuation in thrust becomes large, there will be hammering, which is in the first place a source of noise, and in the second place a source of accelerated wear of bearing 4.

Figure 6:
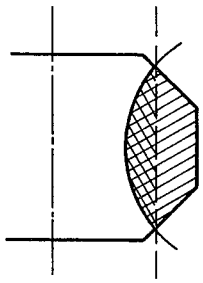
FIG. 6 is a simplified cut view of the screw according to the invention.

On FIG. 6 will be seen a schematic section through the screw of FIG. 1, and as a dotted line the outline of the completely cylindrical screw as suggested in U.S. Pat. No. 3,708,249. The area of the useful section of the screw according to the invention is shown hatched, while in double hatching is shown the useful area according to the U.S. Patent It will be clear that such areas, which in a first approximation are proportional to the swept volume of the screw, are almost three times larger in this invention than in the previous state of the art, without however there being any substantial increase in the leakage paths, i.e. the contact lines between screw and casing, screw and pinion teeth, and pinion teeth and casing. Consequently, there not only is a far greater power weight ratio, hence reduced weight and cost for a given capacity, but a substantial increase in efficiency.

It will be noted that in the example mentioned here, the pump is shown with two symmetrical pinions, but the elimination of axial thrust and the improvement in flow rate, hence of efficiency for a given bulk, would be obtained in the same way by designing a pump with a single pinion, as shown in U.S. Pat. No. 3,708,249. The advantage of having two pinions is also to eliminate the radial thrust while doubling the capacity per revolution, since the screw is swept twice per revolution instead of once.

Figure 7:
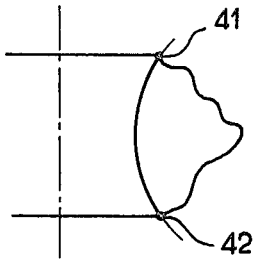
FIG. 7 is a simplified cut view of an alternate embodiment of the screw.

It will also be noted that an example has been depicted in which the external profile of the screw consists of a cylinder between two cones. But a constant thrust could be obtained by having any profile such as shown on FIG. 7, so long as the ends of the threads of screws 41 and 42 are located on substantially equal diameters.

It will also be noted that this invention has been described with a screw meshing with plane pinions, but it could equally be embodied with conical or even cylindrical pinions as covered in French Pat. No. 1,586,832.

Figure 8:
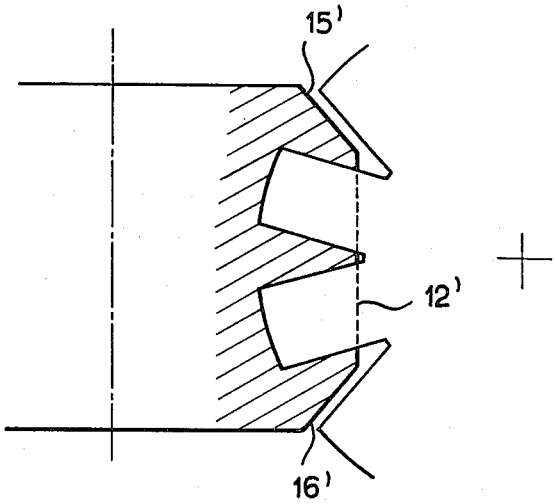
FIG. 8 is a simplified cut view through the screw of FIG. 1.
Figure 9:
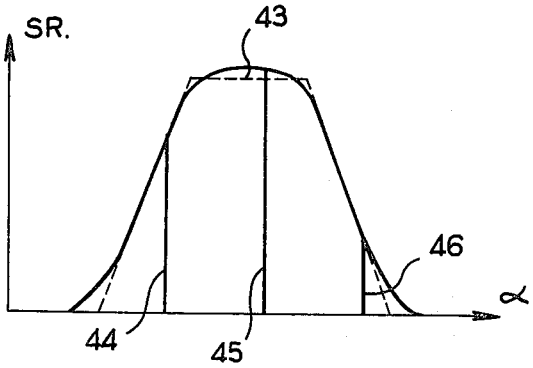
FIG. 9 is a diagram showing the derivative of the volume of a thread versus the angle of rotation.

On FIG. 8 the cross-section of a preferred embodiment of the invention is shown, and on FIG. 9 is shown a graph permitting the computation of the instantaneous flow of the pump versus angle of rotation $\alpha$ of the screw.

The graph has been determined by computing, for various values of $\alpha$, the product of the area S of a pinion tooth exposed to the pressure times the distance R from the center of gravity of such area to the axis of the screw. It is indeed known that such product is the derivative of the volume of the thread as a function of the angle $\alpha$, or, which comes to the same thing, that the product $SRd\alpha$ corresponds to the volume swept by the tooth when the screw rotates through angle $d\alpha$. Product SR may then also be termed the instantaneous flow of a tooth.

On such a graph, the volume swept by the various teeth meshing with the screw may then be readily represented. For example, on FIG. 9 the instantaneous flows generated by three successive teeth cooperating simultaneously with the screw have been depicted by segments 44, 45 and 46. The difference in abscissae between the three segments is the angular interval comprised between the teeth, for instance, 60 degrees if the screw has six threads.

It may moreover be shown that for a cylindrical screw ending in two cones of which the generating lines coincide approximately with the flank of a tooth when the latter leaves the cone, the graph of the product SR will be substantially like a plateau preceded and followed by two almost rectilinear rises covering an angle close to the angle between two successive threads I;e. 60° in the aforementioned case. The plateau and its two rectilinear flanks are shown in dotted line, while the exact values corresponding to the plotting of FIG. 8 are shown in full line.

It is then readily understood that if the plateau also covers an angle equal to the angle between two successive threads, the sum of the three segments 44, 45 and 46 will be virtually constant and will not vary when all three segments are jointly displaced, since indeed segment 45 remains substantially constant along the 60° of the plateau, and since the sum of segments 44 and 46 remains constant and virtually identical to that of segment 45. Since sum of the three segments is equivalent to the instantaneous flow of the various teeth meshing with the screw, the result is that the instantaneous flow is virtually steady, and is very little pulsed.

This feature is of particular importance in a pump since it contributes to avoid noise and vibration in piping under pressure. Absence of pulsation permits amongst other things to eliminate any pneumatic equipment to absorb the vibration.

It will be noted that the fact that the plateau covers an angle equal to the interval between two successive threads, comes to saying that the length of the cylindrical portion of the screw has been chosen so that two successive teeth of the pinion mesh completely with that portion of the cylinder and therefore do not show outside the end cones. By way of a numerical example, a pump was tested depicted in cross section on FIG. 8, consisting of a screw with six threads, of 140 mm diameter ending in two cones of which the generatrices form an angle of 40° with the axis of the scew. The length of the generating line of the cylindrical portion is 38 mm. The screw cooperates with two symmetrical pinions of 140 mm diameter, each of 11 teeth 16 mm wide. The distance between the axis of the screw and the axis of the pinion is 88 mm.

One notes first that two teeth of the pinion may cooperate with the screw in the cylindrical portion without showing out the end cones, to be precise, the angle of rotation of the screw during which a tooth does not show outside a cone and corresponding to plateau 43, is 67°, and the rectilinear parts on either side of the plateau each stretch over about 49°.

These values of 67° and 49° are of the same order of magnitude as the angle of 60°, which separates two subsequent grooves, and the differences between these values and 60° are explainable in that the plateau depicted on FIG. 9 is not strictly flat and the sides of the plateau are not strictly rectilinear.

In constructing graph SR and in summing segments 44, 45 and 46, it is then found that the fluctuation in flow will be $\pm 1.8\%$ which is extremely small.

In fact, measurements performed on such a pump rotating at 1000 revolutions per minute which then sweeps 374 liters per minute, have given a noise level of less than 70 phones at one meter, a quite exceptional value.

Naturally, the invention is not restricted to the examples described and depicted herein, and a number of refinements may be made to such examples without exceeding the scope of the invention.

In particular, the description has covered a pump, but it is understood that the invention equally applies to motors. As a receiver of energy, the screw will then rotate in the direction opposite to that of arrow 5 depicted on FIG. 2.

What is claimed is:

1. A positive displacement hydraulic machine such as a pump or motor comprising in combination a screw with several threads, rotating inside a fixed casing and meshing with at least one pinion having teeth running inside such casing, at least one low pressure port and at least one high pressure port located in the casing on either side of the pinion, the portion of the casing comprised between a low pressure port and a high pressure port being substantially in continuous leaktight contact with the top of at least one thread of the screw through the entire length of said thread, said portion of the casing being in addition so arranged that when it is in leaktight contact with the tops of any two successive threads, no pinion tooth is in mesh between these two threads, and such that the threads terminate on each side of the screw on substantially equal diameters and have in their central section a swollen portion with an external diameter larger than at the ends of the threads.

2. A positive displacement hydraulic machine such as a pump or motor comprising in combination a screw provided with several threads rotating inside a stationary casing and meshing with two pinions provided with teeth arranged inside the casing symmetrically with respect to the axis of rotation of said screw, one low pressure port and one high pressure port being arranged in the casing on either side of each pinion, the areas of the casing located between the low pressure and the high pressure ports contiguous to two different pinions being in permanent, substantially leaktight contact with the top of at least one thread of the screw over the entire length of said thread, said areas of the casing being moreover so arranged that when they are in leaktight contact with the tops of two successive threads, no single tooth of a pinion meshes between such two threads, wherein such threads terminate on either side of the screw on substantially equal diameters, and have in their central section a swollen section of a diameter greater than at the ends of the threads.

3. A machine according to claim 2, wherein such swollen portion comprises a cylinder terminating in two cones which are symmetrical with respect to the plane passing through the center of the pinions and perpendicular to the axis of rotation of the screw.

4. A machine according to claim 3, wherein the cylindrical area encompasses approximately two successive teeth of the pinion.

5. A machine according to claim 4, wherein the generating line of the aforementioned cones is substantially parallel with the side of the tooth where the latter leaves the screw.

6. A machine according to claim 2, wherein it comprises in addition means to generate on the screw an axial back-pressure proportional to the difference in pressure between high and low pressure.

7. A machine according to claim 6, wherein such means comprise pockets on the end faces of the screw, which communicate through duct means with the low pressure and a piston integral with the screw and closing a chamber which communicates with the high pressure through channels.

8. A machine according to claim 1, wherein such swollen portion comprises a cylinder terminating in two cones which are symmetrical with respect to the plane passing through the center of the pinion and perpendicular to the axis of rotation of the screw.

9. A machine according to claim 8, wherein the cylindrical area encompasses approximately two successive teeth of the pinion.

10. A machine according to claim 9, wherein the generating line of the aforementioned cones is substantially parallel with the side of the tooth where the latter leaves the screw.

11. A machine according to claim 1, wherein it comprises in addition means to generate on the screw an axial back-pressure proportional to the difference in pressure between high and low pressure.

12. A machine according to claim 11, wherein such means comprise pockets on the end faces of the screw, which communicate through duct means with the low pressure and a piston integral with the screw and closing a chamber which communicates with the high pressure through channels.

* * * * *